United States Patent [19]

Gray, Sr.

[11] Patent Number: 4,570,470

[45] Date of Patent: Feb. 18, 1986

[54] DOOR LOCK SECURITY DEVICE

[76] Inventor: William H. Gray, Sr., 126 Northgate Parkway East, Toledo, Ohio 43612

[21] Appl. No.: 609,793

[22] Filed: May 14, 1984

[51] Int. Cl.[4] ..... E05B 17/14

[52] U.S. Cl. ..... 70/428; 70/212; 70/424

[58] Field of Search ..... 70/428, 423, 424, 425, 70/426, 427, 209, 212, 211

[56] References Cited

U.S. PATENT DOCUMENTS

| | | | |
|---|---|---|---|
| 1,154,389 | 9/1915 | Fogalsang | 70/209 |
| 1,439,552 | 12/1922 | Johnson | 70/209 |
| 3,457,745 | 7/1969 | Barber | 70/424 |

*Primary Examiner*—Robert L. Wolfe

*Attorney, Agent, or Firm*—George R. Royer

[57] ABSTRACT

The subject invention is a door lock security device adapted to provide a means for preventing a doorknob lock from being opened by a master key or other means through the keyhole while the room is locked from the outside, such device comprising a cover member to envelope and otherwise cover a doorknob of the type which has a locking mechanism integrated therein. The subject covering device comprises a circular ring member comprising two separate retractable members, which are pivotably mounted to one another at a common point about which they can retract or close relative to one another. The circular ring member is adapted to encircle the doorknob in a peripheral manner and is provided with a solid frontal portion to cover the key insert. The solid frontal portion is adapted to fit securely against the outer extremity of the doorknob in which the key slot is structured so as to prevent one from inserting a key or other object into the key slot while it is so covered.

2 Claims, 4 Drawing Figures

DOOR LOCK SECURITY DEVICE

DESCRIPTION OF PRIOR ART AND BACKGROUND OF INVENTION

Security problems involved with hotels and motels have become a problem that is difficult to control externally and internally. Theft from hotel rooms has become a problem of significant concern. One of the problems in this regard is the ability to use a master key or other tool to unlock the room door lock whenever the occupants of the room are temporarily out of the room.

In this regard, door locks with concomitant key inserts, which are integrally emplaced in the doorknob appear to be one of the more common types of locks used in hotels or motels. Such doorknob locks are just as vulnerable, as other lock types, to lock-picking or the use of master keys to enter the room for purposes of stealth.

There exists in the prior art a vast array of safety and security devices to prevent unwanted ingress and egress into rooms or houses. The range of such devices is quite expansive, however, relatively few devices exist which are adapted to secure the outside of the door lock once the occupants leave the room. There are no known devices which are structured to cover a doorknob type lock from the outside so as to prevent tampering with the lock or insertion of objects or keys into the key insert to open same surreptiously. Accordingly, this invention is of the type to prevent ingress into the key insert of a lock structured in a doorknob, and is adapted to overcome the foregoing shortcomings of the prior art, and the following objects of the subject invention are directed accordingly.

OBJECTS

The following are objects of the subject invention:

It is an object of the subject invention to provide an improved door security device;

It is also an object of the subject invention to provide a device for securely covering the key insert in a doorknob lock so as to prevent ingress into the key insert while the occupants are out of the room locked by such doorknob lock;

Another object of the subject invention is to provide an improved security device for motel and hotel door locks;

Yet another object of the subject invention is to provide an improved device for securing locks on doors, particularly of the type that have the locks integrally built into the doorknob assembly;

It is also an object of the subject invention to provide an improved security device;

Other and further objects of the invention will become apparent from a reading of the following description taken in conjunction with the drawings.

DRAWINGS

DESCRIPTION OF GENERAL EMBODIMENT

The subject invention is a locking device for a door locking mechanism of the type that is integrally installed in the door knob of a door. The device is structured to cover the outer door handle and particularly cover the portion of the door handle which holds the key slot for the particular door lock. The subject invention, in general, comprises a ring member formed of two semicircular halves pivotally mounted to one another so that the respective semicircular members can be retracted or closed relative to one another in the closed ring position. The semicircular members are formed with an inner surface which is concave, as seen from the inside, so that such semicircular members are able to conformingly fit around the convex circumferential periphery of a door knob when semicircular members are enclosed in the ring disposition. On the outer edges of each semicircular member is disposed a circumferential edge which extends in a perpendicular direction relative to the central axis of the ring member. This structured arrangement enables a solid disc member to be inserted and clasped in the closed ring to cover the key slot when the locking device is positioned in the closed position over a doorknob, as more fully described hereinafter.

DESCRIPTION OF PREFERRED EMBODIMENT

In the following description of the subject invention, and particularly the preferred embodiment thereof, it is to be indicated that this description is one form or embodiment of this invention, and other embodiments of the subject invention are contemplated. Moreover, the description, as set forth below, is directed to only one embodiment of the door locking device encompassing the subject invention, however, the application of the invention herein is to all types of door locking devices falling within the scope of the claims.

Additionally, the language and terminology set forth below will be utilized in developing the description of preferred embodiment.

(a) The word "upper" will be used in reference to those areas of the device which are generally directed vertically above and away from the floor; the word "lower" will be used in opposite sense to "upper".

(b) The words "longitudinal central axis" will refer to any imaginary axis extending symmetrically through the longest or longitudinal extent of the part discussed;

(c) The words "frontal" or "anterior" will be used interchangeably to describe orientations of the device incorporating the subject invention, which face outward from the door on which the device is used. The word "posterior" will be used to describe orientations opposite thereto.

Figure 1:
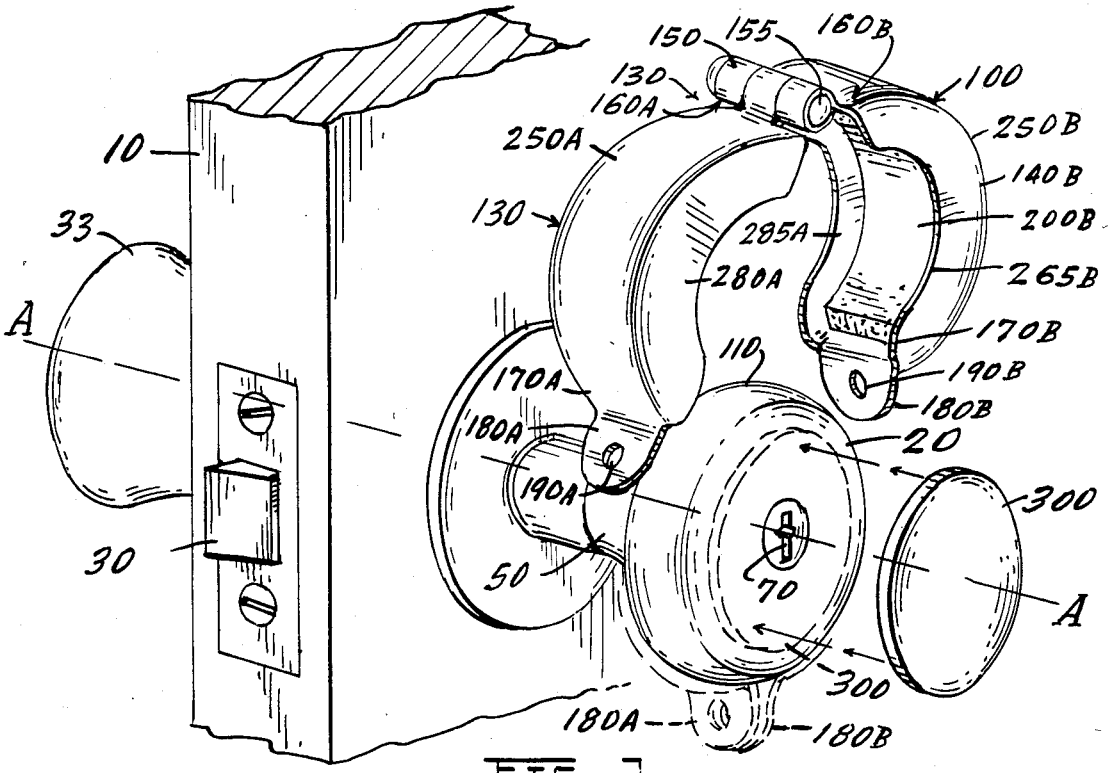
FIG. 1 is a perspective view of the subject invention as it is used in connection with a doorknob having an integral door lock therein.

Referring now to the drawings, and particularly to FIG. 1 in which a preferred embodiment of the subject invention is shown, a conventional door member 10 is shown having a typical rounded doorknob 20 disposed on the outside of door 10, with attendant latch 30 affixed on the adjacent edge of such door 10, as seen. The doorknob 20 operates in conventional fashion by turning same in a clockwise or counterclockwise direction to retract the door latch 30 from a slot, not shown, in order that the door 10 can be opened accordingly. Inside doorknob 33 is shown in FIG. 1 as being aligned along the same axis as doorknob 30.

Figure 2:
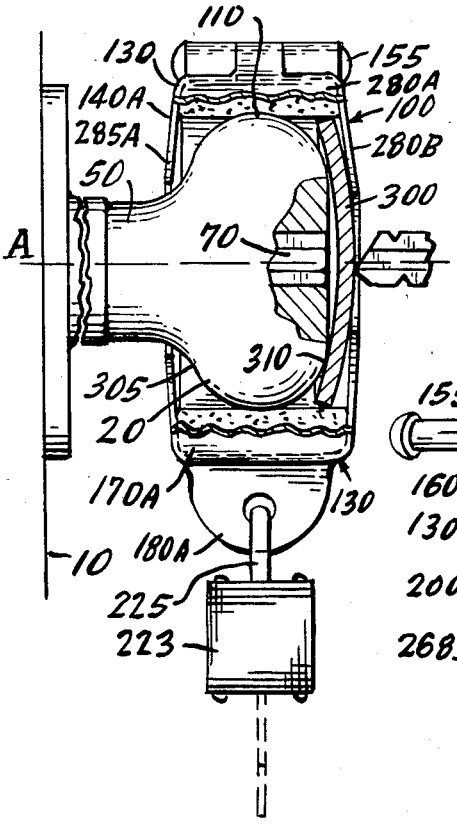
FIG. 2 is a side elevation view, in cross section, of the subject invention, as it is shown in place over a doorknob handle.

Integrally assembled into the doorknob 20 and attendant shank assembly 50 is a locking mechanism the precise details of which are not shown in the drawings. However, shown in FIGS. 1 and 2 is the key slot 70 which is integrated directly into the outer portion of said doorknob 20, with the key slot being generally aligned along the longitudinal central axis A—A of the outer doorknob 20 and the door handle shank 50, as shown, particularly in FIG. 2. Thus, as seen the locking mechanism, including key slot 70, is structured in the doorknob handle, and is of such a type that when locked, blocks the rotation of the door handle shank 50, which in turn prevents the latch 30 from being moved from the latch holder, not shown. This structural and operational aspect serves to keep the door 10 locked, as desired. The door handle 20 integrated into door 10, with concomitant lock structure is generally a conventional structural arrangement for doorknob lock mechanism described.

Figure 4:
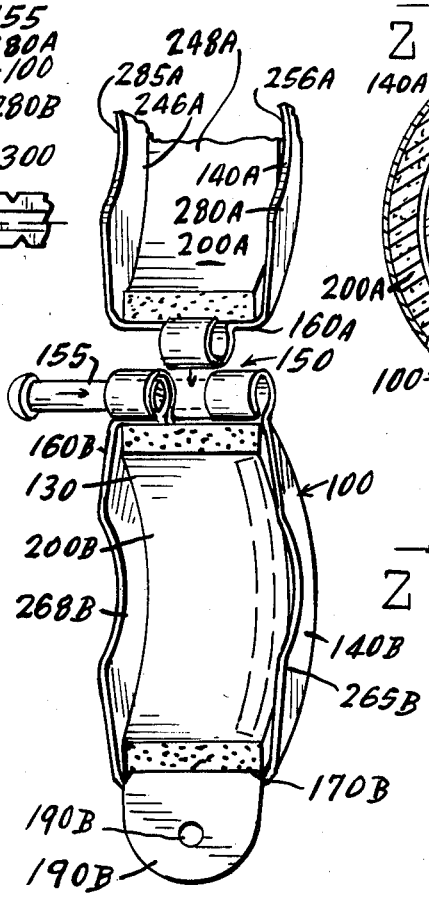
FIG. 4 is a cross sectional view, from a perspective view of the subject invention showing the subject invention in the opened position.

Referring now again to the drawings, and particularly to the illustration shown in FIG. 1, the device 100 incorporating the subject invention is shown in the open or retracted position as it is about to be enclosed about the outer convex circumference 110 of the doorknob handle 20, as shown. As can be seen, the subject device 100 is comprised of a ring member 130, which ring member is, in turn, formed of two girdling, semicircular members 140A and 140B. The respective semicircular members 140A and 140B are respectively mating concave members as viewed from the end elevational view of FIG. 3, which are pivotably joined to one another at hinge mechanism 150, including hinge pin 155, seen in FIGS. 1, 3 and 4. More particularly, the semicircular members 140A and 140B are arcuately shaped members, each of which form a half circle, or one hundred and eighty degrees of a circle, as shown, with one being essentially the mirror image of the other.

Figure 3:
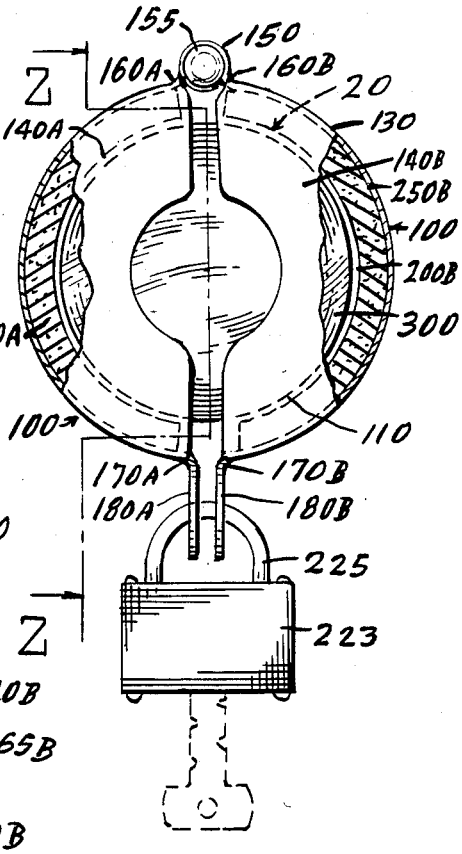
FIG. 3 is a front elevational view of the subject invention.

The upper ends 160A and 160B respectively of such semicircular members are the ends that are joined together to the common hinge element 150. Thus, as can be seen, the two semicircular members 140A and 140B can be pivotally moved relative to one another from the open position shown in FIG. 1 to the closed circular ring position shown in FIG. 3. The upper ends of such semicircular members 140A and 140B are alternately referred to as the first ends 160A and 160B. The opposite ends of the semicircular members 140A and 140B are referred to as the lower ends, or second ends 170A and 170B respectively. Disposed on each of the lower ends 170A and 170B of the semicircular members 140A and 140B are depending lobe-like tangs 180A and 180B respectively. Such depending tangs 180A and 180B each have therein circular openings 190A and 190B, as shown. When the two opposing semicircular members 140A and 140B are drawn together in the closed circular position shown in FIG. 3, the respective tangs 180A and 180B on the second ends 170A and 170B abut one another in a flush manner, such that the respective openings 190A and 190B are aligned relative to one another. In this latter position a padlock 223 locking loop 225 can be inserted through such openings to lock the semicircular members 140A and 140B together in the closed circular position, as particularly shown in FIG. 3. As seen in FIG. 3, the semicircular members 140A and 140B are of such a diametric size that when they are closed relative to one another, as seen in FIG. 3, they fit conformingly and securely about the doorknob 20 circumference 110, in a ring configuration.

Each semicircular member 140A and 140B has an inner peripheral surface 200A and 200B that is concave, as viewed from the elevational view of FIG. 3. This rounded inner periphery thus conforms to the rounded, convex configuration of the outer surfaces 250A and 250B of the respective semicircular members 140A and 140B, to provide the semicircular configuration of each semicircular member 140A and 140B, as seen from viewing FIG. 3. This latter feature enables the semicircular members 140A and 140B to fit conformingly around the outer circumferential 110 of the doorknob 20, as shown in the drawings. As seen, the semicircular member 140A has both a frontal and posterior rimmed flange 280A and 285A on its frontal and back surface, as shown. The posterior flanged rimmed flange 285A is a semicircular member which extends radially inwardly from the posterior edge 246A of the inner periphery 248A of the semicircular member 140A. This flanged rim 285A, as shown, is perpendicular to the axis A—A when the device is positioned over the doorknob. The frontal rimmed flange 280A extends radially inwardly from the frontal edge 256A of the inner periphery of the semicircular member 140A, as seen. As seen, the frontal rim 280A extends a greater distance radially inwardly from the inner peripheral than does the posterior rim 285A. The opposing semicircular member 140B similarly has frontal and posterior rimmed flanges 265B and 268B structured identically, in mirror image fashion to the rimmed flanges on semicircular member 140A.

When the subject locking device 100 is positioned over the doorknob 20, it can be seen that the posterior rimmed flanges 285A and 268B on each semicircular member 140A and 140B rest down over and against the rear periphery 305 of the doorknob 20, while the front rimmed flanges 280A and 265B rest down over the frontal periphery 310 of the doorknob 20. By this arrangement, when the locking device is locked around the doorknob 20 in handcuff fashion as the two semicircular members 140A and 140B are enclosed relative to one another, the respective rimmed flanges keep the subject locking device 100 from moving axially frontally or posteriorly relative to doorknob handle 20, as can be seen graphically in FIG. 2.

A disc member 300 is adapted to be inserted just posterior and adjacent the frontal rimmed flanges 280A and 265B, just as the locking device is to be emplaced over the doorknob 20, as seen in the drawings. For this purpose, the disc member 300 is of a diameter which is slightly smaller than the inner circumference of the semicircular member, but larger than the frontal rimmed flanges 280A and 265B on the respective semicircular members 140A and 140B. The disc fits vertically just rearward and adjacent of the flange members such that when the semicircular member 140A and 140B are clamped in place around the doorknob 20, the disc is upright and is held against the outersurface 430 of the doorknob 20 so that the key slot is covered and cannot be reached.

While a preferred embodiment of the subject invention has been described, it shall not be considered as limiting the scope of the subject invention.

I claim:

1. A locking device for affixation over a doorknob handle of the type in which there is an integrally disposed key slot in said doorknob handle, having a circumference and an outer surface, said device comprising:

(a) a pair of semicircular members pivotally respectively having first ends and second ends, said semicircular members being pivotally joined one another on their adjoining first ends, each said semicircular member having a convex outer circumference and a concave inner circumference;

(b) flanged rimmed edges on each of the semicircular members, extending radially inwardly relative to each said semicircular member;

(c) locking means on the second end of each semicircular member to join together said respective semicircular members in a closed circle about the doorknob;

(d) disc means adapted to be inserted between the flanges on said semicircular members so as to rest against the front surface of the doorknob when the semicircular members are locked together.

2. A locking security device for a doorknob of the type in which a locking key slot is integrated into said doorknob, comprising:

(a) a ring member comprised of two semicircular members, each formed as a half circular member, each said semicircular member having first ends and second ends, said semicircular girding members being pivotally joined one another on their adjoining first ends, each said semicircular girding member having a convex outer circumference and a concave inner circumference;

(b) flanged rimmed edges on each of the semicircular members, extending radially inwardly relative to each said semicircular member;

(c) locking member in the form of lobed tangs with openings thereon on the second end of each semicircular member to join together said respective semicircular members in a closed circle about the doorknob;

(d) disc means adapted to be inserted between the flanges on said semicircular members so as to rest against the front surface of the doorknob when the semicircular members are locked together;

(e) means to lock said semicircular members together.

* * * * *